US005390724A

United States Patent [19]

Yamauchi et al.

[11] Patent Number: 5,390,724

[45] Date of Patent: * Feb. 21, 1995

[54] LOW PRESSURE DIE-CASTING MACHINE AND LOW PRESSURE DIE-CASTING METHOD

[75] Inventors: Noriyoshi Yamauchi; Hitoshi Ishida, both of Fuchu, Japan

[73] Assignee: Ryobi Ltd., Hiroshima, Japan

[ * ] Notice: The portion of the term of this patent subsequent to Oct. 5, 2010 has been disclaimed.

[21] Appl. No.: 76,742

[22] Filed: Jun. 15, 1993

[30] Foreign Application Priority Data

Jun. 17, 1992 [JP] Japan ..... 4-184436

[51] Int. Cl.[6] ..... B22D 39/00; B22D 39/02

[52] U.S. Cl. ..... 164/147.1; 164/335; 164/337; 164/500; 222/594

[58] Field of Search ..... 164/133, 136, 155, 335, 164/336, 337, 119, 156, 147.1, 500; 222/602, 594

[56] References Cited

U.S. PATENT DOCUMENTS

| | | | |
|---|---|---|---|
| 1,843,491 | 2/1932 | Tornberg | 164/337 |
| 1,983,579 | 12/1934 | Ennor | 164/337 |
| 3,157,923 | 11/1964 | Hodler | 164/337 |
| 4,073,414 | 2/1978 | Garab | 222/602 |

FOREIGN PATENT DOCUMENTS

| | | | |
|---|---|---|---|
| 495615 | 7/1992 | European Pat. Off. . | |
| 512669 | 11/1992 | European Pat. Off. . | |
| 2636665 | 2/1978 | Germany | 164/254 |
| 87747 | 8/1930 | Japan . | |
| 50-13225 | 2/1975 | Japan . | |
| 242751 | 3/1990 | Japan . | |
| 5-42354 | 2/1993 | Japan | 222/594 |

*Primary Examiner*—P. Austin Bradley
*Assistant Examiner*—Jeffrey T. Knapp
*Attorney, Agent, or Firm*—Sughrue, Mion, Zinn, Macpeak & Seas

[57] ABSTRACT

A low pressure die-casting machine has a ladle unit, a molten metal pressurizing unit, a switching unit, and a controller. The ladle unit has an intake/discharge port with a cross-sectional area in a range of from 20 to 80 $mm^2$ so as to be capable of successively supplying the molten metal to a desired location. The molten metal pressurizing unit is switchable between two positions. One position is for selectively supplying compressed air to the ladle to positively discharge the molten metal from the ladle through the intake/discharge port. The other position is for selectively isolating the ladle in order to retain the molten metal therein. The switching unit is connected between the molten metal pressurizing unit and the ladle. It is switchable between first and second change-over positions. The first change-over position is for providing fluid communication between the ladle and the molten metal pressurizing unit. The second change-over position is for providing fluid communication between the ladle and the atmosphere. The controller is connected to the molten metal pressurizing unit for selectively driving the molten metal pressurizing unit. The controller is also connected to the switching unit for driving the switching unit.

19 Claims, 6 Drawing Sheets

LOW PRESSURE DIE-CASTING MACHINE AND LOW PRESSURE DIE-CASTING METHOD

BACKGROUND OF THE INVENTION

The present invention relates to a low-pressure die-casting machine and method, and more particularly, to a die-casting machine and method for successively transporting molten metal from a melting pot to the casting port of a metal mold and filling the cavity of the metal mold with the molten metal. Hereinafter, introducing molten metal into a ladle so that the molten metal accumulates therein for transporting the molten metal from the melting pot to the metal mold will be referred to as "supply." Hereinafter, discharging molten metal from the ladle into a casting port of the metal mold will be referred to as "pouring."

Problems have been observed when automatically pouring a molten metal having a small mass, such as from 5 grams to several hundreds grams, into a casting port of a die-casting machine. That is, maintaining accuracy of the pouring amount and preventing the molten metal from cooling in the ladle have proven difficult. Several proposals have been made to overcome these problems.

For example, Japanese Patent No. 87747 discloses a piston/cylinder arrangement in which a piston is slidably disposed in a cylinder whose one end is formed with a molten metal intake/discharge port. The piston is slidingly moved in one direction while the cylinder is dipped in the molten metal accumulated in a melting pot., This generates negative pressure within the cylinder so the molten metal flows into the cylinder through the molten metal intake/discharge port. The piston is later slidingly moved in the opposite direction, whereupon the molten metal retained in the cylinder is discharged into a metal mold through the molten metal intake/discharge port.

Further, Japanese Patent Application Kokai No. SHO 50-13225 discloses a device having a support tube movable in the vertical direction and rotatable about its axis and a plurality of casting tubes radially extending from the support tube. An air intake passage and air chamber are formed in the support tube. The air chamber is in communication with the casting tubes through arm tubes. Generating negative pressure at the air intake passage applies negative pressure to the arm tubes through the air chamber whereupon molten metal accumulated in a pot is sucked into the casting tubes. While maintaining this state, the support tube is rotated to bring the casting tube into a predetermined position corresponding with a casting port of a metal mold.

Furthermore, Japanese Utility Model Application Kokai No. HEI-2-42751 describes a pouring device having a ladle for rotary style low pressure casting. The ladle has an intake/discharge port formed in the lower tip. A plug is movably provided in the interior of the ladle for closing and opening the intake/discharge port. The ladle is lowered into the molten metal until the intake/discharge port is dipped therein. The interior of the ladle is then decompressed via a pressurizing/decompressing device so that the molten metal is sucked into the interior of the ladle. After a predetermined amount of molten metal is supplied to the ladle, the plug seals the intake/discharge port. The ladle is then moved to a casting port of the metal mold and brought into sealing contact therewith. Before the plug is moved away from the discharge port, the pressurizing/decompressing device slightly decompresses the interior of the ladle so that when the plug opens the intake/discharge port, pouring is performed in a controlled manner. The interior of the ladle is then returned to atmospheric pressure to expedite the rate of pouring.

The above described conventional molten metal supplying devices have several disadvantages. First, in the Japanese Patent 87747 reference, the molten metal may enter into the sliding portion of the cylinder/piston mechanism. If molten metal solidifies there, subsequent molten metal cannot be supplied. This problem tends to worsen the smaller the amount of molten metal supplied. This is because smaller amounts of molten metal have smaller heat capacity so the temperature of smaller amounts rapidly decreases. Further, if the molten metal enters into the opposite side of the piston, the reciprocating mechanism there may also be damaged. Moreover, the suction of the molten metal by negative pressure may cause excessive turbulence in the molten metal in the cylinder. If the cylinder is elevated while the molten metal is turbulent, the amount of the molten metal within the cylinder cannot be accurately gauged, which in turn degrades accuracy in the molten metal supply. On the other hand, waiting for the molten metal to become stationary requires a relatively prolonged period.

According to Japanese Patent Application Kokai No. 50-13225, the plurality of casting tubes radially provided around the support tube requires intricate molten metal passages be formed within the support tube and the casting tubes. This complicated structure increases production cost of the device. Further, since the molten metal is sucked under negative pressure, the molten metal abruptly enters the casting tubes. This could cause the molten metal to enter into the molten metal passages in the arm tubes. If the molten metal adheres to the walls of the passage and solidifies there, a clog may form which prevents subsequent supply of molten metal. Further, the device has drawbacks similar to those of the above described patent reference since a vacuum suction system is also utilized.

The same problems can also occur in the pouring device described in Japanese Utility Model Application Publication (Kokai) No. HEI-2-42751 which also uses a pressurizing/decompressing device for supplying molten metal into the ladle. Also because the supply/discharge port is sealed and opened using a plug, impurities, for example aluminum, that solidify and accumulate around the exterior of the intake/discharge port can prevent the ladle from coming into sealing contact with the casting port, thereby obstructing pouring. Also if aluminum impurities deposit to the interior of the intake/discharge port or the exterior of the plug, the plug will not form a complete seal with the intake/discharge port so that molten metal will drip from the ladle during transport of the molten metal. The low pressure of the ladle interior at the time of pouring can cause air to enter therein, thereby generating voids in the casted product. Pouring can become impossible at certain levels of decompression. Because many trials must be performed to determine the most appropriate pressure, adjusting pressure is troublesome.

SUMMARY OF THE INVENTION

It is therefore, an object of the present invention to overcome the above described prior art drawbacks and to provide an improved low pressure die casting apparatus and method in which temperature drop of the molten metal in the ladle can be prevented in spite of the transfer of the small amount of the molten metal, and leakage of the molten metal from the ladle is avoidable during the transfer, to thereby maintaining accuracy in pouring amount.

Another object of the invention is to provide such apparatus and method capable of reducing shot cycle, and avoiding air entry into the molten metal in the ladle at the time of pouring, and capable of promptly discharging the molten metal in the ladle toward the metal mold.

These and other objects of the invention will be attained by providing a low pressure die-casting apparatus including a metal mold having a casting port, and a ladle unit for retaining and transporting a predetermined amount of a molten metal in a metal pot to the casting port, the ladle unit having an upper portion, a bottom portion having a molten metal intake/discharge port formed therein, and an inner surface defining a molten metal accumulation space, a molten metal pressurizing means, a switching means and a controller. The intake/discharge portion of the ladle unit has a cross-sectional area in a range of from 20 to 80 $mm^2$, and the bottom portion of the ladle unit is in pressure contactable with the casting port. The molten metal pressurizing means is switchable to one position for selectively applying pneumatic pressure to the accumulation space in order to positively discharge the molten metal through the intake/discharge port to the metal mold. The molten metal pressurizing means is also switchable to another position. The switching means is connected between the molten metal pressurizing means and the upper portion of the ladle unit. The switching means is switchable between a first position for isolating the accumulation space from an atmosphere and a second position for providing fluid communication between the accumulation space and the atmosphere. The controller is connected to the switching means and produces a first signal for driving the switching means between the first position and the second position. The controller is also connected to the molten metal pressurizing means and produces a second signal for selectively driving the molten metal pressurizing means between the one position and the other position.

In another aspect of the invention, there is provided a low pressure die-casting method including the steps of communicating an interior of a ladle with an atmosphere for supplying molten metal accumulated in a pot to the interior of the ladle through an intake/discharge port formed in the bottom portion of the ladle, isolating the interior of the ladle from atmosphere for transporting the ladle to a casting port of a metal mold, pressure contacting the ladle with the casting port, communicating the interior of the ladle with the atmosphere for pouring the molten metal by atmospheric pressure and the weight of the molten metal from the interior of the ladle into a cavity formed in the metal mold, subjecting the molten metal to a low pressure after a predetermined duration of time passes for expediting discharge of the molten metal from the interior of the ladle to the cavity, applying pressure to the molten metal in the cavity during solidification of the molten metal in the cavity, opening the metal mold after another predetermined duration of time passes, and removing a casted product from the opened metal mold.

For supplying the molten metal into the ladle, the interior of the ladle is communicated with the atmosphere by the switch means, and the ladle is maintained at a predetermined height relative to the pot. Since the intake/discharge port has a sufficient cross-sectional area capable of allowing the molten metal to be smoothly introduced into the ladle interior, the molten metal can be supplied into the ladle in a short time until the surface level of the molten metal in the ladle becomes equal to the surface level of the molten metal in the pot. Then, the switch means is operated to isolate the ladle interior from the atmosphere. The ladle is then moved to the casting port while maintaining this isolation. In this case, since the intake/discharge port has a cross-sectional area capable of providing a sufficient surface tension which can avoid leakage of the molten metal through the port, the molten metal is not scattered out of the ladle. Further, in this case, the molten metal is slightly lowered because of its own weight, so that the a part of the molten metal is bulged out of the intake/discharge port. Therefore, internal air volume is slightly increased to reduce internal pressure. Thus, the molten metal retaining ability of the ladle can further be enhanced. In this aspect also, the cross-sectional area of the intake/discharge port is determined so as to overcome the molten metal bulging thereat. When the intake/discharge port is aligned with the casting port, the switch means is operated so as to again communicate the ladle interior with the atmosphere, so that the molten metal can be discharged into the metal mold because of its own weight and the atmospheric pressure applied thereto. Further, the molten metal pressurizing means is operated so that a low pressure is applied to the molten metal in the ladle through the switch means, which has its open state, to expedite the discharge of the molten metal.

DETAILED DESCRIPTION OF THE PREFERRED EMBODIMENTS

Figure 1:
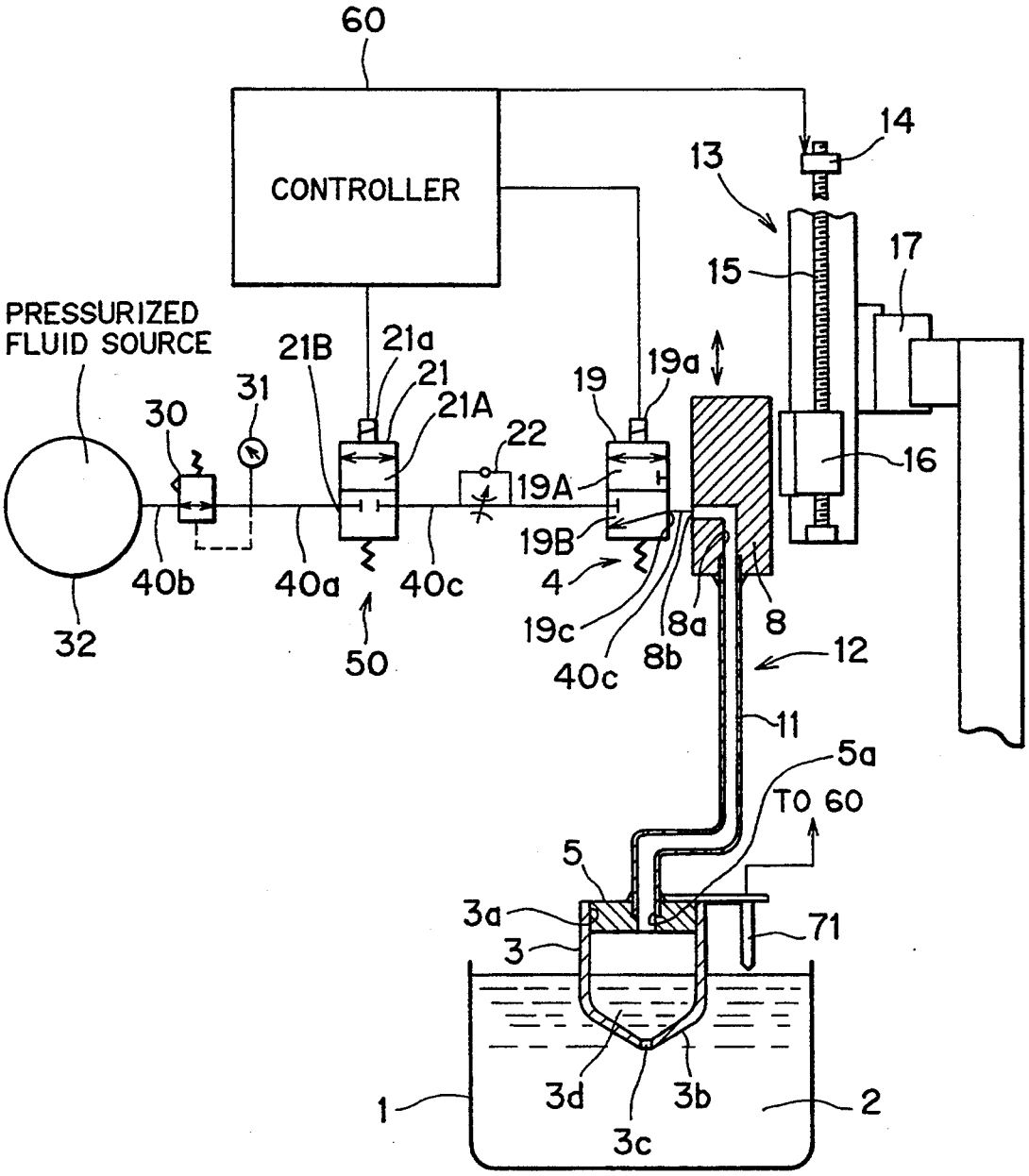
FIG. 1 is a schematic view showing a low pressure die-casting machine according to a first embodiment of the present invention in a supply state.

A low pressure die-casting machine and method according to a first embodiment of the present invention will be described with reference to FIGS. 1 and 2. A ladle 3 used in the depicted embodiment is adapted to be movably dipped in molten metal 2 accumulated in a pot 1. The ladle 3 has an upper open end portion 3*a* and a tapered bottom portion 3*b*. The apex of the bottom portion 3*b* is formed with a molten metal intake/discharge port 3*c*. A lid portion 5 is engageable with the upper open end portion 3*a* for closing the open end thereof. The lid portion 5 and the ladle 3 define a molten metal accumulating space 3*d*. A through hole 5*a* is bored in the lid portion 5. The through hole 5*a* is connected to a switching unit 4 via a tube 11. A molten metal detection sensor 71, which is connected to a controller 60 of the die-casting machine, is provided to the lid portion 5 for adjusting the downward movement of the ladle 3.

The switching unit 4 has a block 8 and a first electromagnetic valve 19. In the block 8 is formed a fluid passage 8*a*. One end of the fluid passage 8*a* is connected to the tube 11 and the other end 8*b* to the first electromagnetic valve 19. The electromagnetic valve 19*a* has a solenoid which is electrically connected with the controller 60. The solenoid 19*a* switches the electromagnetic valve 19 between a first change-over position 19A and a second change-over position 19B according to a switching signal output by the controller 60. The first change-over position 19A brings the other end 8*b* of the block 8, and subsequently the accumulation space, into communication with a molten metal pressurizing unit 50 to be described later. The second change-over position 19B brings the other end 8*b* of the block 8 into communication with the atmosphere.

The ladle 3 and the switching unit 4 constitute a molten metal supplying unit 12 which is supported by a vertical moving unit 13. The vertical moving unit 13 includes a drive motor 14 electrically connected to the controller 60 of the die-casting machine, a ball screw 15 coupled to the drive motor 14, and a slider 16 threadingly engaged with the ball screw 15. The block 8 is attached to the slider 16. The ball screw 15 rotates about its axis when the drive motor 14 rotates. The rotation of the ball screw 15, depending on the direction of the rotation, raises or lowers the slider 16 so the dipping amount of the ladle 3 into the pot 1 is controllable. The vertical moving unit 13 is connected to a transfer unit 17, such as a transport rail, for horizontally carrying the ladle 3 until its intake/discharge port 3*c* is aligned with the casting port (not shown in FIG. 1) of a die-casting machine (to be described later). After pouring, the transfer unit 17 returns the ladle 3 to the pot 1.

The switching unit 4 is connected to the molten metal pressurizing unit 50. The molten metal pressurizing unit 50 is for introducing a low pressure fluid into the ladle 3 within a predetermined time after start of pouring for expediting discharge of molten metal from the ladle 3. The molten metal pressurizing unit 50 includes a pressurized fluid source 32 for supplying air or an inert gas, a pressure regulation valve 30 connected to the pressurized fluid source 32 by a line 40*b*, a second electromagnetic valve 21 connected to the pressure regulation valve 30 by a line 40*a*, an indicator 31 connected to line 40*a* between the pressure regulation valve 30 and the second electromagnetic valve 21, and a flow rate regulation valve 22, having a check valve, connected to line 40*c* between the first and second electromagnetic valves 19 and 21.

The second electromagnetic valve 21 has a solenoid 21*a* electrically connected to the controller 60 of the die-casting machine. The solenoid 21*a* switches the second electromagnetic valve 21 between a first change-over position 21A and a second change-over position 21B. The first change-over position 21A fluidly connects the pressurized fluid source 32 with the first electromagnetic valve 19. The second change-over position 21B blocks fluid communication between the pressurized fluid source 32 and the first electromagnetic valve 19. Upon receiving a command signal from the controller 60, the solenoid 21*a* switches the second electromagnetic valve 21 to the first change-over position 21A. Pressurized fluid from the pressure fluid source 32 can then flow through the pressure regulation valve 30, the second electromagnetic valve 21, and the line 40*c*, where the flow rate regulation valve 22 limits the inherently large volume of pressurized fluid into a small volume of the fluid before it is introduced to the molten metal at the interior of the ladle 3.

Figure 3:
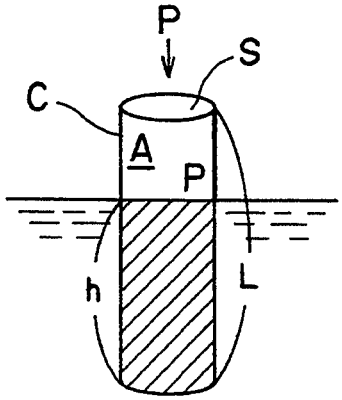
FIG. 3 is a view showing a molten metal introduction state for description of molten metal retaining principle in the ladle.

The molten metal retaining principle of the ladle 3 will next be described with reference to FIGS. 3 through 5. Since the supplying device 12 has a structure in which an interior of the ladle is selectively communicated with the atmosphere, various problems may arise if the cross-sectional area of the intake/discharge port 3*c* is too large or too small.

Although molten metal flows more rapidly through a large port, whereupon the efficiency of supply is increased, if the port is too large, the molten metal within the ladle may easily leak through the port. Leakage lowers accuracy of molten metal amount and might damage or otherwise affect ambient mechanical components and working areas dripped on during transfer of the molten metal. Also, a large cross-sectional area may allow the oxide film formed on the surface of the molten metal in the pot to flow into the ladle with the molten metal. When the oxide layer is poured into the metal mold, the quality of the resultant casted product may be degraded.

On the other hand, although a small cross-sectional area at the intake/discharge port 3*c* prevents the molten metal from leaking through the port, it also prevents the molten metal from being smoothly introduced into the ladle. Further, molten metal discharging speed from the ladle may drop. This results in a prolonged shot cycle and lower productivity. When small amounts of the molten metal are carried in the ladle, slight increases in the shot cycle can cause great decreases in the temperature of the molten metal. In view of the above, the area of the molten metal intake/discharge port is extremely important.

Assuming that a sleeve member C having both open ends has a cross-sectional area of S and a length of L. The sleeve member C is partially dipped into a liquid having a density l to a depth h as shown in FIG. 3. The part of the sleeve member C that does not dip into the liquid has a volume A, and is at atmospheric pressure P. While maintaining this condition, as shown in FIG. 4, the upper open end of the sleeve member C is closed by a lid D, and then the sleeve member C is removed from the liquid. Provided that the diameter of the sleeve member C is smaller than a certain size, the liquid is preventing from discharging from the sleeve member C. However, the liquid bulges out of the lower open end as shown in FIG. 4. Accordingly, as shown in FIG. 4, the liquid height in the sleeve member C drops from h to h', the volume of the inner space defined by the lid D increases from A to B, and the inner pressure drops from P to P'. The force balance capable of retaining the liquid in the sleeve member C can be equationally represented as:

$$P'+ph'=P$$

because atmospheric pressure P is applied to the lower open end portion of the sleeve C. Incidentally, the pneumatic pressure P' within the confined space of the sleeve C can be equationally represented as:

$$P'=(L-h)P/(L-h').$$

Since the numerator (L−h) is smaller than the denominator (L−h'), P' is evidently smaller than P.

Figure 5:
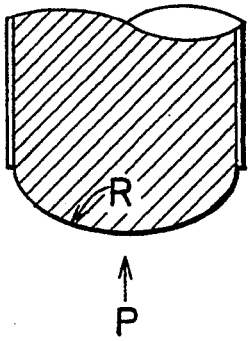
FIG. 5 is a view showing a configuration of the retained molten metal at an intake/discharge port for description of molten metal retaining principle.

The liquid surface at the bottom open end of the sleeve C has a roundish shape as shown in FIG. 5. Because of the surface tension of the liquid, the liquid in the sleeve C can be retained therein. The pressure difference ΔP between inner and outer surfaces of the retained liquid can be equationally represented as:

$$\Delta P=2T/R$$

where T represents the surface tension, and R represents radius of curvature of the bulging liquid. If the pressure difference ΔP is lower than a predetermined level, it becomes impossible for the surface tension of the liquid to hold the liquid in the sleeve at the lower open end portion thereof. On the other hand, since the radius of curvature is proportional to the diameter of the sleeve, the radius of curvature R becomes large if the sleeve has a large diameter. The pressure difference ΔP therefore lowers because the surface tension T is a constant value.

Figure 2:
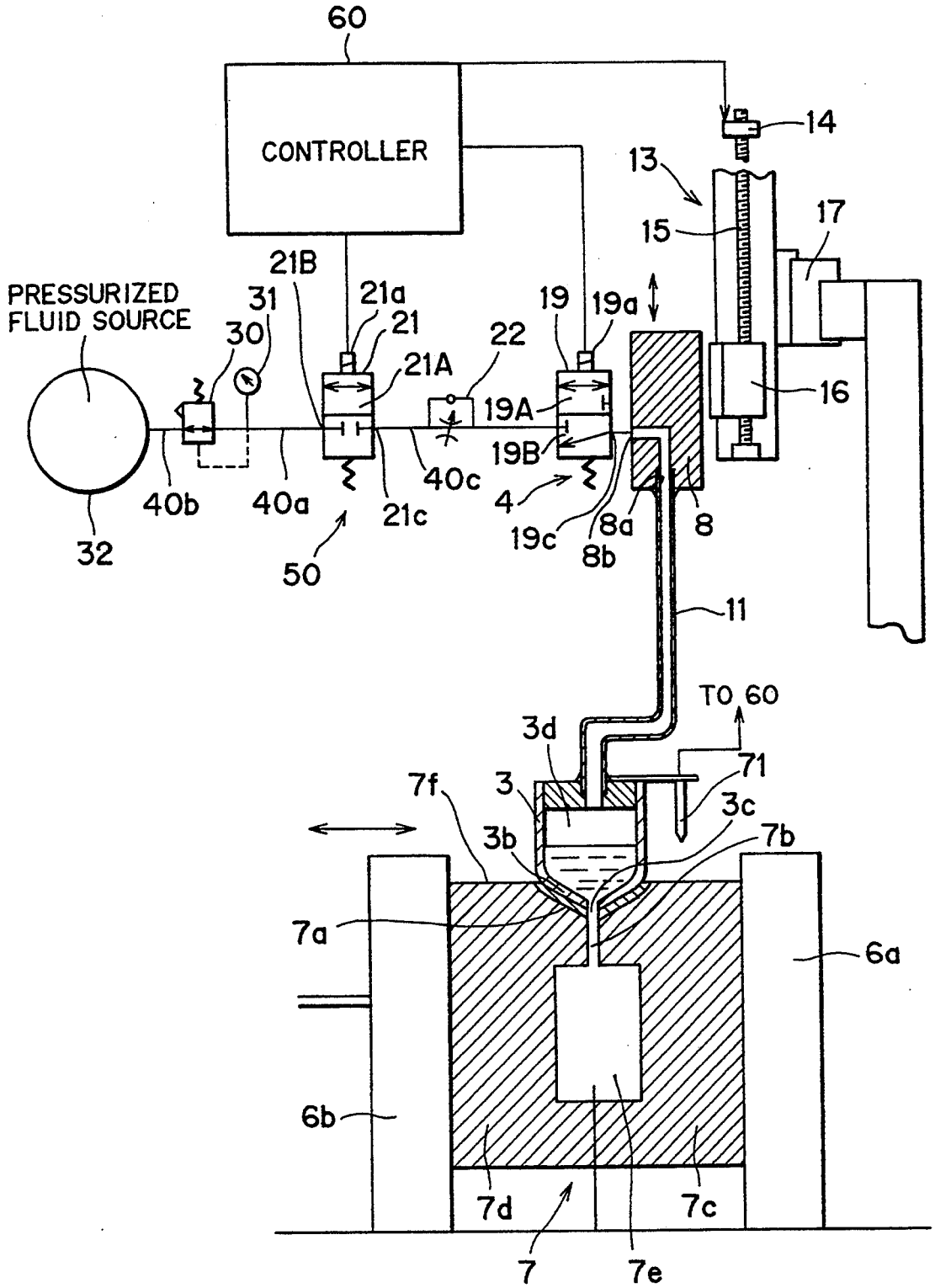
FIG. 2 is a schematic view showing a low pressure die-casting machine according to a first embodiment of the present invention in a pouring state.

This analysis of the sleeve diameter can be applied to determine the intake/discharge port diameter of the ladle 3 shown in FIG. 1. That is, in order to reduce the shot cycle and to enhance the pressure reducing effects provided by the liquid bulging, a relatively large diameter sleeve is required. However, in order to maintain the reduction in the pressure difference ΔP within a predetermined range, the diameter of the sleeve must be relatively small. Thus, it would be understood that the diameter must be determined in view of these conflicting criteria.

The cross-sectional area of the intake/discharge port 3*c* of the depicted embodiment is analogous to the cross-sectional area of the sleeve member C. Experiments have been conducted using different sized sleeves in order to investigate amounts of molten metal which would leak from various diameter intake/discharge ports 3*c*. The molten metal was aluminum (JISADC10), and the temperature of the molten metal was 770±10° C. Ten sleeve members were prepared having diameters of 5 mm, 6 mm, 7 mm, 8 mm, 9 mm, 10 mm, 11 mm, 12 mm, 13 mm, and 15 mm. Molten metal supplying amounts were 60 plus minus 10 g and 180 plus minus 10 g, and leakage of the molten metal through the sleeve members were measured in each case for both supplying amounts.

The result of the experiments where that when supplying 60 plus or minus 10 g of molten metal no molten metal leaked from sleeve members having diameters ranging from 5 mm to 10 mm. On the other hand, small amounts of molten metal leaked from sleeve members having diameters ranging from 11 to 13 mm. A great deal of molten metal leaked from sleeves having 15 mm diameter. The results were the same when 180 plus or minus 10 g of molten metal was supplied.

As is apparent from the above described experiments, 10 mm is the greatest diameter whereby surface tension prevents leakage and retains molten metal in the ladle 3. Thus, the maximum available cross-sectional area is about 80 $mm^2$.

Next, molten metal entering ability into the ladle 3 in relation to the area of the intake/discharge port 3*c* is investigated. As described above, the molten metal can be retained in the ladle 3 if the area of the intake/discharge port 3*c* is not more than 78.5 $mm^2$ (about 80 $mm^2$). On the ) other hand, if the area is too small, like having a diameter of 5 mm, that is smaller than 19.6 $mm^2$ (about 20 $mm^2$), the supply speed and pouring speed of molten metal drops. Consequently, the temperature of the molten metal in the ladle may drop, which causes a degradation of the molded product. Further, a prolonged shot cycle may result thus lowering productivity. The above discussion shows clearly that a cross-sectional area between 20 $mm^2$ and 80 $mm^2$ is appropriate.

Next, the metal mold 7 for which the present invention is used will be described while referring to FIG. 2. The metal mold 7 includes a stationary metal die 7*c*, fixed to a stationary platen 6*a* of the metal mold 7, and a movable metal die 7*d* fixed to a movable platen 6*b*. At parting faces of the stationary metal die 7*c* and the movable metal die 7*d* a cavity 7*e* and a runner 7*b* are formed. A casting port 7*a*, which is in communication with the runner 7*b* is formed in the upper surface of the metal mold 7. The casting port 7*a* is in a form of a conical recess having a shape mating with the lower outer portion profile of the ladle 3. A heat insulation material 7*f* is provided to the surface of the casting port 7*a*.

Next, operation of the low pressure casting machine according to the first preferred embodiment will be described. The controller 60 sends a signal to a metal die opening/closing device (not shown), whereupon the metal mold opening/closing device moves the movable metal die 7*d* into abutment contact with the stationary metal die 7*c*. After the metal mold 7 is closed and while the second electromagnetic valve 21 has the second change-over position 21B, the controller 60 of the die-casting machine outputs an open valve signal to the solenoid 19*a* of the switching unit 4. The first electromagnetic valve 19 then switches to the second change-over position 19B. Therefore, the molten metal accumulation space 3*d* of the ladle 3 is brought in communication with the atmosphere via the tube 11, the fluid passage 8*a* formed in the block 8 and the first electromagnetic valve 19.

A lowering signal is outputted from the controller 60 of the die-casting machine to the vertical moving unit 13 whereupon the motor 14 rotates by a predetermined angular amount so as to rotate the ball screw 15 about its axis, to thereby lower the slider 16 to a predetermined position. Thus, the lower portion of the ladle 3 is dipped in the molten metal 2 by a predetermined depth. That is, when the molten metal detection sensor 71 detects the molten metal, a molten metal detection signal is outputted to the controller 60 whereupon output of the lowering signal is stopped and the position of the ladle 3 is maintained. Because the molten metal accumulating space 3*d* is communicated with the atmosphere via the tube 11, the fluid passage 8*a* formed in the block 8, and the electromagnetic valve 19 as described above, the molten metal 2 in the pot 1 flows into the molten metal accumulation space 3*d* until the level of the molten metal in the space is equal to the molten metal surface level in the pot 1.

When a predetermined duration of time passes after the molten metal detection signal is outputted, the controller 60 outputs a valve closing signal to the solenoid 19*a* of the first electromagnetic valve 19. The solenoid 19*a* switches the first electromagnetic valve 19 to the first change-over position 19A, communicating the molten metal accumulation space 3*d* with the second electromagnetic valve 21. Because the second electromagnetic valve 21 is in the second change-over position 21B at this point, the molten metal accumulation space 3*d* is shut off from the atmosphere.

Subsequently, a raising command from the controller 60 causes the vertical moving unit 13 to elevate the molten metal supplying unit 12. That is, the ball screw 15 rotates reversely so that the ladle 3 rises. Because the molten metal accumulation space 3*d* is shut off from the atmosphere and because the intake/discharge port 3*c* has a proper diameter, molten metal 2 is not discharged from the intake/discharge port 3*c*. When the slider reaches a maximum upper position, the motor 14 stops.

After the molten metal supplying unit 12 is elevated, the transfer unit 17 is operated for moving the molten metal supplying unit 12 to directly above the movable metal die 7*d* and the stationary metal die 7*c*, whereupon the vertical moving unit 13 is operated to lower the molten metal supplying unit 12 to a predetermined position where the lower portion of the ladle 3 is engaged with the insulating material 7*f* at the casting port 7*a*.

When lowering is completed, the molten metal in the ladle 3 is poured into the cavity 7*e*. That is, the controller 60 again sends a valve opening signal to the first electromagnetic valve 19, whereupon the first electromagnetic valve 19 switches to the second change-over position 19B. Consequently, atmosphere enters the molten metal accumulation space 3*d* of the ladle 3 via the first electromagnetic valve 19, the fluid passage 8*a*, the tube 11, and the through hole 5*a*. As a result, the molten metal in the ladle 3 pours through the intake/discharge port 3*c* and the runner 7*b*, by atmospheric pressure and its own weight, and fills the cavity 7*e*.

After a predetermined amount of time passes, the controller 60 sends discharge signals to the first electromagnetic valve 19 and the second electromagnetic valve 21, whereupon the first electromagnetic valve 19 switches to the first change-over position 19A and the second electromagnetic valve 21 switches to the first change-over position 21A. This brings the pressurized fluid source 32 into fluid connection with the molten metal accumulation space 3*d*. Because the rate at which pressurized fluid is released from pressurized fluid supply 32 is regulated to a predetermined low pressure by the pressure regulation valve 30, a low pressure is applied to the molten metal accumulation space 3*d*. The low pressure expedites discharge of the molten metal from the accumulation space 3*d* so that pouring time is minimized. Also pouring is accurate. The time duration that the pressurized fluid is applied can be adjusted by a timer (not shown) in the controller 60 to corresponding to the pouring time. Low pressure is also applied for a predetermined duration of time after the molten metal fills the cavity 7*e* for hardening the molten metal to prevent shrinkage cavities.

After pouring is completed (i.e. after a predetermined duration of time has passed), the vertical moving unit 13 raises the molten metal supplying unit 12 to the upper maximum position. The controller 60 of the die-casting machine outputs a transport drive signal, whereupon the transfer unit 17 moves the molten metal supplying unit 12 to a position above the pot 1. After another predetermined time duration passes after start of pouring, the controller 60 outputs a metal mold opening signal to the metal mold opening/closing device(not shown), whereupon the movable metal die 7*d* is moved away from the stationary metal die 7*c*. A casted product pushing device (not shown) then pushes the casted product from the movable metal die 7*d*. Afterward, an air blow device (not shown) blows air onto the surface of the cavity 7*e* formed in the stationary metal die 7*c* and the movable metal die 7*d* to remove casting fin, etc. therefrom. Next, a releasing agent applicator (not shown) applies a releasing agent to the surface of the cavity 7*e*. The above operation is repeatedly carried out for effectively and successively pouring a predetermined amount of molten metal into the cavity 7*e*.

Next, a low pressure die-casting machine according to a second embodiment of this invention will be described with reference to FIG. 6, wherein like parts and components are designated by the same reference numerals as those shown in FIGS. 1 and 2. The second embodiment is substantially similar to the first embodiment except for the switching unit 4'.

More specifically, the switching unit 4' of the second embodiment includes a valve body 8', an opening/closing valve 10, an pneumatic cylinder 9 for opening and closing the opening/closing valve 10, and an opening/closing valve drive unit 18 to be described later. The opening/closing valve 10 is connected to a piston 10*a* which is slidingly provided in the pneumatic cylinder 9. The piston 10*a* separates the pneumatic cylinder 9 into a first cylinder chamber 9*a* and a second cylinder chamber 9*b*. The first and second cylinder chambers 9*a* and 9*b* are connected to ends of a first through passage 9*c* and a second through passage 9*d* respectively. The other ends of the first through passage 9*c* and the second through passage 9*d* are connected to the pressurized fluid source 32 via the opening/closing valve drive unit 18. The valve body 8' has a valve chamber 8'*d* in which the opening/closing valve 10 is movably provided. The valve body 8' is provided with a seal member 8'*c* and is formed with a bore 8'*a* at a position in abutment with the opening/closing valve 10. Further, a communication hole 8'*b* is formed at a side wall of the valve chamber 8'*d* for bringing the valve chamber 8'*d* into communication with the atmosphere via a electromagnetic valve 21' to be described later. The bore 8'*a* is connected to the through hole 5*a* of the lid 5 by means of the tubular member 11.

The opening/closing valve drive unit includes a first electromagnetic valve 18 having a first and a second solenoids 18*a* and 18*b*. The first electromagnetic valve 18 is connected to the pressurized fluid source 32 by way of a fluid passage 51. The first and second solenoids 18*a* and 18*b* are connected to the controller 60 of the die-casting machine through lines 60*a* and 60*b*, respectively. The controller 60 sends open valve signals to the first solenoid 18*a* via line 60*a*, and close valve signals to second solenoid 18*b* via line 60*b*, for switching the first electromagnetic valve 18 between a first change-over position 18X and a second change-over position 18Y. (FIG. 6 shows the second change-over position 18Y.) The ends of the first and second passages 9*c* and 9*d* that oppose the ends connected to the first and second cylinder chamber 9*a* and 9*b*, respectively, are connected to the first electromagnetic valve 18. Thus, pressurized fluid is selectively applied to one of the first and the second cylinder chambers 9*a* and 9*b* for moving the piston 10 downwardly or upwardly to thereby open or close the opening/closing valve 10.

The communication hole 8'b of the valve chamber 8'd is connected to the molten metal pressurizing unit 50'. The molten metal pressurizing unit 50' is provided for smoothly discharging the molten metal from the ladle 3. As described above, while the opening/closing valve 10 is open during pouring, the molten metal pressurizing unit 50' applies a small amount of low pressure pressurized fluid to the surface of the molten metal within the ladle 3 via the fluid passage formed by the tube 11, the bore 8'a, the valve chamber 8'd, and the communication hole 8'b. Therefore, the molten metal pressurizing unit 50' in the second preferred embodiment has almost exactly the same structure as that of the first preferred embodiment, except that in the second preferred embodiment, the second electromagnetic valve 21' is provided with release port 21'c. Also, in the second preferred embodiment, the molten metal accumulation space 3d is brought into communication with the atmosphere through the release port 21'c (See FIG. 6) when the first electromagnetic valve 18 is in the second change-over position 18Y while the second electromagnetic valve 21' is in the first change-over position 21'X.

As in the first preferred embodiment the second electromagnetic valve 21' is provided with a solenoid 21'a which is connected to the controller 60. Also similar to the first preferred embodiment, the solenoid 21'a has a second change-over position 21'y for connecting the molten metal accumulation space 3d with the pressurized fluid source 32. As shown in FIG. 6, the second electromagnetic valve 21' is urged into the first change-over position 21'X by the spring 21'b. Therefore until an operating signal is sent to the second electromagnetic valve 21', fluid communication between the pressurized fluid source 32 and the communication hole 8'b is obstructed. In this condition, the communication hole 8'b is in communication with the atmosphere via the line 40c and the release port 21'c of the second electromagnetic valve 21'. The pneumatic cylinder 9 is electrically connected to the controller 60 of the die-casting machine. The air cylinder 9 outputs an operation completion signal S1 to the controller 60 after the opening/closing valve 10 is opened. In response to the operation completion signal, the controller 60 sends an operation signal to the second electromagnetic valve 21'.

Operation of the low pressure die-casting machine according to the second preferred embodiment will be explained. As in the first preferred embodiment, after closing the metal molds 7c, 7d, and while the second electromagnetic valve 21' has its first change-over position 21'x, the controller 60 outputs opening signals to the solenoid 18a via line 60a. Consequently, the first electromagnetic valve 18 switches from the first change-over position 18X to the second change-over position 18Y. (FIG. 6 shows the electromagnetic valve 18 in the second change-over position 18Y.) Therefore, the pressurized fluid from the pressurized fluid source 32 is supplied to the second cylinder chamber 9b, via the fluid passage 51, the first electromagnetic valve 18, and the second passage 9d, and the pressurized fluid in the first cylinder chamber 9a is discharged to the atmosphere via the first passage 9c and the electromagnetic valve 18. Therefore, the opening/closing valve 10 moves away from the seal member 8'c and the bore 8'a so that the bore 8'a and the communication hole 8'b come into fluid communication with each other. Thus, atmosphere enters the molten metal accumulation space 3d via the release port 21'c, the line 40c, the communication hole 8'b, the valve chamber 8'd, the tube 11, and the through hole 5a.

As in the first preferred embodiment, the vertical moving unit 13 lowers the ladle 3 to a predetermined depth into the molten metal 2. After a predetermined amount of molten metal enters the ladle 3, the opening/closing valve 10 is closed. That is, when the opening/closing valve closing signal from the controller 60 of the die-casting machine reaches the solenoid 18b, the first electromagnetic valve 18 switches to the first change-over position 18X and pressurized fluid from the pressurized fluid source 32 is supplied to the first cylinder chamber 9a via the fluid passage 51, the electromagnetic valve 18, and the first passage 9c. The pressurized fluid within the second cylinder chamber 9b is discharged to the atmosphere via the second passage 9d and the electromagnetic valve 18. Therefore, the opening/closing valve 10 comes into abutment contact with the seal 8'c so that the molten metal accumulation space 3d is cut off from the atmosphere.

Next, as in the first preferred embodiment, the vertical moving unit 13 raises the ladle 3 from the molten metal 2. The molten metal supplying unit 12 is brought by the transport unit 17 and the vertical moving unit 13 into contact with the heat insulation material 7f at the casting port 7a.

Pouring operations are the same as in the first preferred embodiment. That is, the opening/closing valve 10 is opened by again operating the pneumatic cylinder 9, whereupon atmosphere enters the molten metal accumulating space 3d via the release port 21'c of the second electromagnetic valve 21'. The molten metal pours into the cavity 7e via the intake/discharge port 3c because of its own weight and atmospheric pressure.

After the opening/closing valve 10 is opened by the operation of the pneumatic cylinder 9, an operation completion signal is sent to the controller 60 of the die-casting machine, which in turn outputs an operation command signal to the second electromagnetic valve 21'. The second electromagnetic valve 21' switches from the first change-over position 21'x shown in FIG. 6 to the second change-over position 21'y. The pressurized fluid supplied from the pressurized fluid source 32 then passes through the flow rate regulation valve 22 at a regulated rate. A small amount of pressurized fluid is thus sent to the ladle 3, thereby expediting the discharge of molten metal from the molten metal accumulation space 3d. As a result, pouring time is reduced. Also, pouring is accurate. Subsequent operations are the same as in the first preferred embodiment and so their explanation will be omitted.

Next, a low pressure casting machine according to a third preferred embodiment of the present invention will next be described with reference to FIG. 7. The third preferred embodiment is an improvement on the first and the second preferred embodiments in order to further prevent the molten metal retained in the ladle 3 from leaking out of the intake/discharge port 3c during transportation of the ladle 3. To be more specific, during transfer of the molten metal, heat from the molten metal may cause air confined in the ladle 3 and the tube 11 to expand. Therefore, in FIG. 4, the pressure P' of the confined space B may increase and reach the proximity of atmospheric pressure P. The inner pressure increase may cause molten metal 2 retained in the ladle 3 to drip therefrom.

Stated differently, the molten metal may leak through the port 3c until the increased inner pressure drops back to P'. Such molten metal leakage may cause reduction or variation in the casting amount, which in turn degrades accuracy. This problem increases the larger the cross-sectional area of intake/discharge port 3c, for example, when the diameter of the port 3c is in the proximity of 10 mm. The third embodiment is provided with a suction unit 120 communicated with the hermetically confined space B in FIG. 4 for decompressing the air therein by an amount corresponding to the expansion amount, i.e., in order to maintain the inner pressure P' within the confined space B of FIG. 4.

Figure 4:
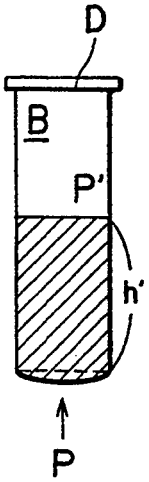
FIG. 4 is a view showing a molten metal retaining state for description of molten metal retaining principle.
Figure 7:
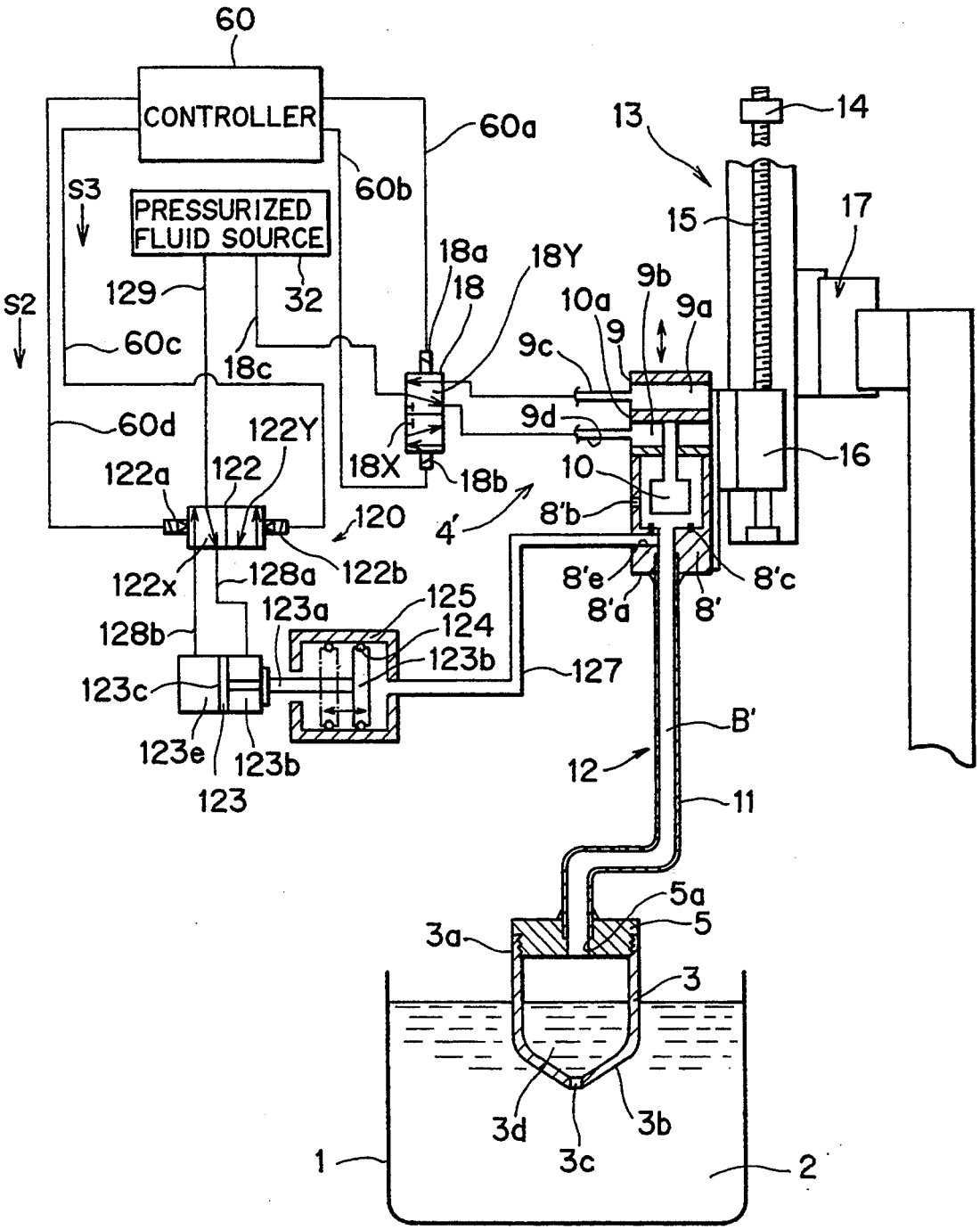
FIG. 7 is a schematic view showing a low pressure die-casting machine according to a third embodiment of this invention.

In FIG. 7, a confined space B' in the ladle 3 and the tube 11 corresponds to the confined space B shown in FIG. 4. The confined space B' is connected to the suction unit 120. The suction unit 120 includes a pneumatic cylinder 123, a cylinder rod 123a, a piston 123b, a cylinder 125, an O-ring 124, and an electromagnetic valve 122. One end of the cylinder 125 is connected to one end of a fluid line 127. The other end of the air line 127 is connected to a communication hole 8'e in communication with the bore 8'a of the valve body 8'. The piston 123b is slidably disposed within the cylinder 125 through the O-ring 124. The piston 123b is integrally coupled, through the rod 123a, to a piston 123c which is slidably disposed in the pneumatic cylinder 123. The piston 123c divides the pneumatic cylinder 123 into first and second chambers 123d and 123e which are connected to the electromagnetic valve 122 through passages 128a and 128b, respectively. The electromagnetic valve 122 can be switched between first and second change-over positions 122X and 122Y. The first and second solenoids 122a and 122b are connected to a controller 60 of the die-casting machine through lines 60d and 60c, respectively.

With this arrangement, the molten metal is retained in the ladle 3 by shutting off the molten metal accumulation space 3d from the atmosphere by a method similar to that used in the second preferred embodiment, that is, by closing the opening/closing valve 10. In the depicted embodiment, operation of the suction unit 120 is started when the ladle 3 is initially raised from an upper surface of the molten metal 2 in the pot 1 in accordance with the lifting motion of the molten metal supplying unit 12 by the actuation of the vertical moving unit 13. However, the operational start timing of the suction unit 120 is not limited to this ladle timing. Various timings are conceivable in conjunction with change in inner pressure caused by the temperature increase in the confined space B'.

A decompression signal S2 is transmitted from the controller 60 of the die-casting machine to the first solenoid 122a of the electromagnetic valve 122 through the line 60d. As a result, the electromagnetic valve 122 is changed-over to the first change-over position 122X, so that pressurized fluid in the pressurized fluid source 32 is supplied to the first chamber 123d of the cylinder 123 through the pressurized fluid line 128a. Consequently, the piston 123b is moved leftwardly in FIG. 7 to have a chain line position. Thus, inner volume of the confined space B' increases, thereby reducing pressure in the space B'. The amount of air to be positively sucked from the confined space B' is determined according to the pressure increase in the tube 11, etc. caused by thermal expansion of the air incurred when molten metal is introduced into the ladle 3. To this effect, the piston 123c undergoes a stroke-adjustment. Therefore, in the illustrated embodiment, pressure increase caused by the air expansion in the confined space B' can be canceled by the suction of air, to thereby maintain the inner pressure to the P' level or less than P' in the confined space B'. Thus dripping of the molten metal from the intake/discharge port 3c during ladle transportation is avoided.

Pouring molten metal into the cavity 7e is achieved in a manner similar to that described in the first embodiment. Here, in order to facilitate the molten metal discharge from the ladle 3, the suction unit 120 provides a pouring stand-by state in which inner pressure of the confined space B' is slightly increased. That is, a stand-by signal is transmitted from the controller 60 to the second solenoid 122b of the electromagnetic valve 122 through the line 60c, so that the electromagnetic valve 122 is Changed-over to the second change-over position 122Y. Accordingly, pressurized fluid in the pressurized fluid supply 32 is supplied to the second chamber 123e of the cylinder 123 through the pressurized fluid line 128b for moving the piston 123b rightwardly in FIG. 7. Thus, the piston 123b has the solid line position for slightly increasing pressure in the confined space B' for facilitating discharge of the molten metal. That is, the suction unit 120 doubles as the molten metal pressurizing unit in the first and second preferred embodiments.

Figure 6:
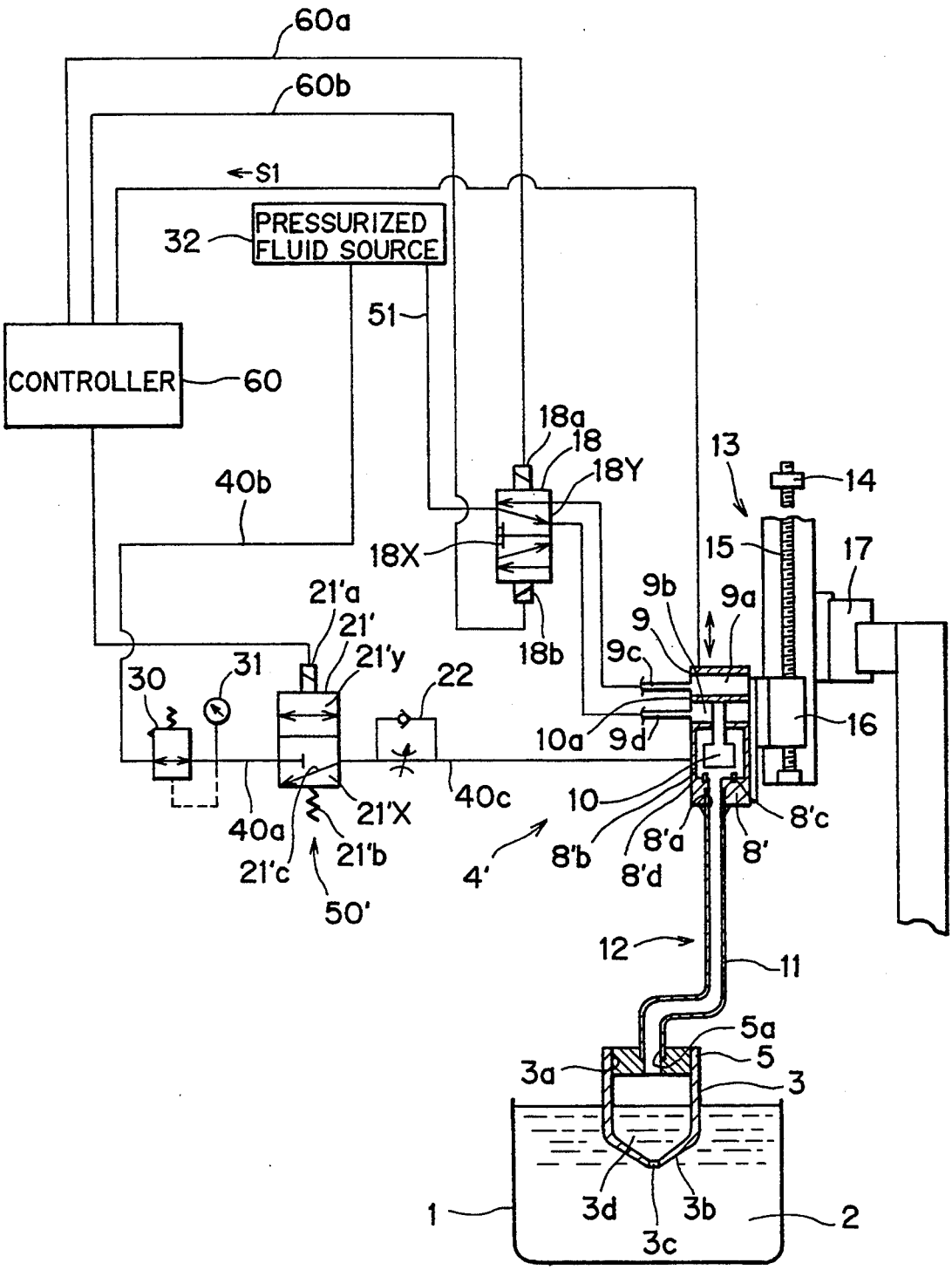
FIG. 6 is a schematic view showing a low pressure die-casting machine according to a second embodiment of this invention.

Although in the third preferred embodiment as shown in FIG. 7, the molten metal accumulation space 3d is in communication with the atmosphere via the hole 8'b when the opening/closing valve 4' is in the open state, a molten metal pressurizing means 50' such as shown in FIG. 6 could be connected to the hole 8'b.

Next, a low pressure die-casting machine according to a fourth embodiment of this invention will be described with reference to FIG. 8. Similar to the third embodiment, the forth embodiment is an improvement on the first and the second embodiments in that suction unit 120A is provided. However, structure of the suction unit 120A is different from that of the third embodiment. The suction unit 120A of the fourth embodiment generally includes an electromagnetic valve 134 and an ejector 131. The electromagnetic valve 134 is connected to a communication hole 8'e' formed in the valve body 8' through an air passage 135, and is connected to the ejector 131 through a check valve 133. The ejector 131 has an inlet port connected to a pressurized fluid source 32 and an outlet port connected to a muffler 132. A pressurized fluid such as compressed air is continuously supplied to the ejector 131 from the pressurized fluid source 32, and the air is discharged, with noise reduction, to the atmosphere through the muffler 132. Therefore, a low pressure zone 131a with pressure lower than atmospheric pressure is provided within the ejector 131. The electromagnetic valve 134 is provided for selectively communicating the low pressure zone 131a with the communication hole 8'e.

The electromagnetic valve 134 is provided with a solenoid 134a connected to the controller 60 of the die-casting machine so as to provide first and second change-over positions 134c and 134d of the valve 134. Further, a spring 134b is connected to the electromagnetic valve 134 for normally urging the latter 134 toward the first change-over position 134c. Furthermore, a close port 134e is provided at the first change-over position side of the electromagnetic valve 134, and is plugged by a plug member 134f. The controller 60 is provided with a timer (not shown). During the timer ON state, a suction signal is continuously applied to the solenoid 134 for switching the electromagnetic valve 134 to the second change-over position 134*d*. Incidentally, the timing and duration of the ON period, during which the increased pressure in the confined space B' is reduced to the pressure P', are previously determined by tests.

With this arrangement, the low pressure zone 131*a* is always provided within the ejector 131 because of the continuous compressed air supply from the pressurized fluid source 32. Similar to the third embodiment, the opening/closing valve 10 is closed before transport of the ladle 3 to shut off the molten metal accumulation space 3*d* from the atmosphere in order to retain the molten metal in the ladle 3. The vertical moving unit 13 is operated for lifting the molten metal supplying portion 12. Immediately after the ladle 3 leaves the surface of the molten metal in the pot 1, the timer is rendered ON. In response to the ON signal, the suction signal is transmitted to the solenoid 134*a* for moving the electromagnetic valve 134 to the second change-over position 134*d* against the biasing force of the spring 134*b*. Therefore, the low pressure zone 131*a* is brought into communication with the confined space B' through the check valve 133, the electromagnetic valve 134, and the air passage 135. Accordingly, the pressure which has increased within the confined space B' due to the heat of the molten metal is introduced into the ejector 131. Thus, similar to the third embodiment, the pressure increase within the confined space B', i.e., within the ladle and the tube 11, is canceled so that the pressure within the space B' becomes equal to or less than the pressure P', to thereby avoid leakage of the molten metal during transport.

When the timer is rendered OFF, generation of the suction signal stops. Thus, the electromagnetic valve 134 is moved to the first change-over position 134*c* because of the biasing force of the spring 134*b*. Accordingly, the confined space B' is disconnected from the ejector 131. The plug member 134*f* prevents the air within the confined space B' from discharging to the atmosphere.

Figure 8:
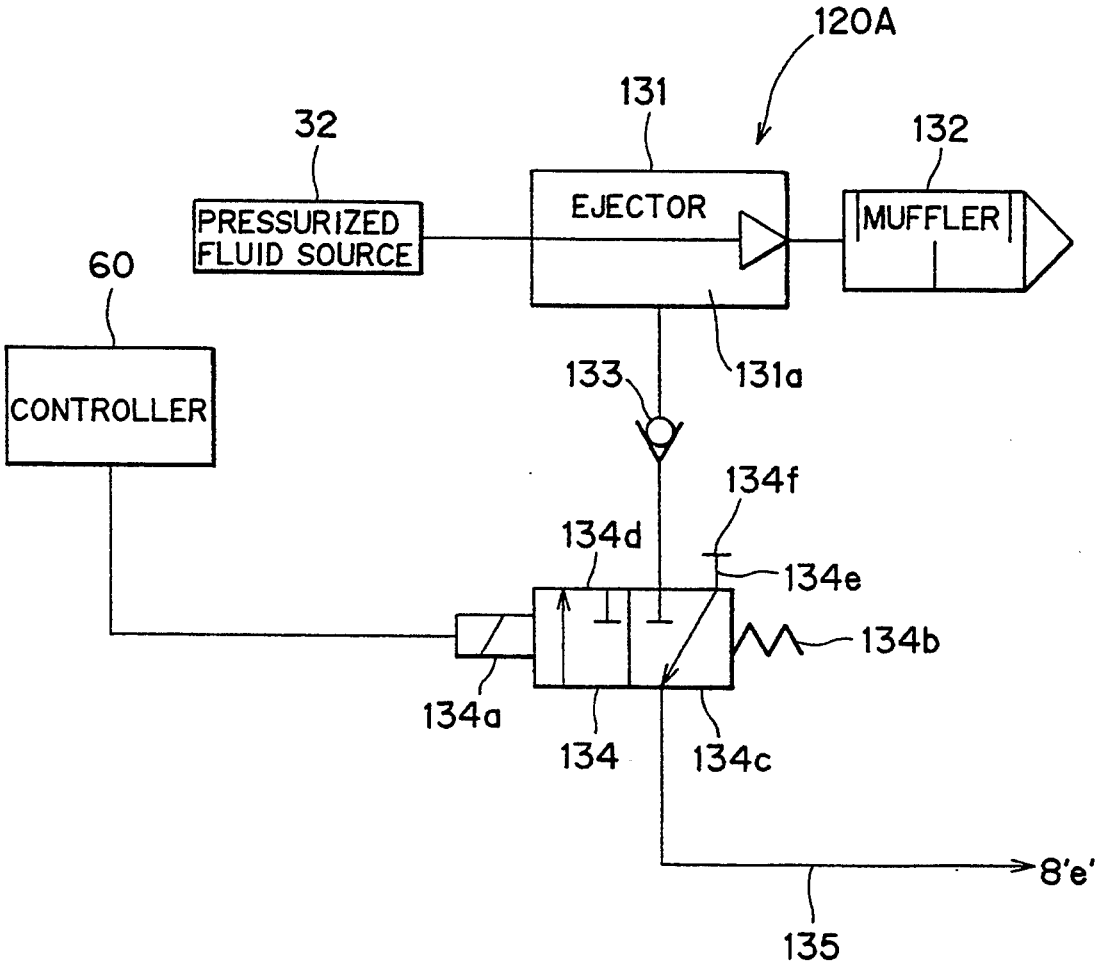
FIG. 8 is a schematic view showing an essential portion of a low pressure die-casting machine according to a fourth embodiment of this invention.

The fourth preferred embodiment as shown in FIG. 8 can be connected at the communication hole 8'*b* (see FIG. 7) to a molten metal pressurizing unit 50 or 50' which is the same as shown in FIG. 1 or FIG. 6 for filling the cavity 7*e* with the molten metal.

Further, in the foregoing preferred embodiments, additional pressurizing unit can be provided in addition to the pressurizing unit 50 or 50'. The additional pressurizing unit introduces fluid into the ladle at a pressure value higher than the pressure of the fluid provided by the molten metal pressurizing unit 50 or 50'. Accordingly, molten metal that remains in the molten metal accumulation space 3*d* or that hangs from the intake/discharge port 3*c* in an icicle fashion can be blown away by the highly pressurized fluid. That is, by introducing the pressurized fluid at volumes or pressures much greater than those of the pressurized fluid introduced into the ladle at the time of pouring, molten metal suspended from the intake/discharge port can be removed so that subsequent molten metal can be accurately introduced into the ladle in the next shot cycle.

As described above, according to the low pressure die-casting machine of this invention, since the cross-sectional area of the intake/discharge port of the ladle is properly selected, dripping of the molten metal from the ladle during transportation is avoided and the molten metal in the ladle can be stably and easily retained therein. Since no molten metal drips from the ladle, accuracy in molten metal supplying amount can be improved. Further, since the cross-sectional area of the intake/discharge port is not less than 20 $mm^2$ the molten metal can be smoothly introduced into the ladle, and the molten metal can be smoothly discharged therefrom without any significant reduction in the discharge speed. Accordingly, temperature decrease of the molten metal in the ladle can be kept to a minimum by reducing the shot cycle. Because of the reduction in the shot cycle, generation of the oxide film at the molten metal surface in the ladle can also be avoided, which leads to the enhancement of quality of the molded product.

A low pressure die-casting machine or method according to the present invention has the additional improvement of applying a low pressure pressurized fluid to the molten metal in the ladle during pouring to expedite discharge of the molten metal from the intake/discharge port more effectively than solely by atmospheric pressure and the weight of the molten metal. Therefore, pouring time can be reduced. Also, pouring amount is more accurate. Because pouring time is reduced, temperature reduction of the molten metal in the ladle can be minimized. Also, the shot cycle can further be reduced. Further, no positive pressure reduction in the ladle is executed during poring, and therefore, air does not enter the ladle through the intake/discharge port, thereby guaranteeing high quality of the casted product. The overall structure of the die-casting is simplified, thereby reducing its manufacture costs.

Furthermore, according to the low pressure device of the third and fourth embodiments, the suction unit is selectively connected to the confined space of the ladle and the tube extending between the ladle and the switching unit in order to prevent the pressure within the confined space from increasing. Therefore, pressure increase due to air expansion incurred by the retention of the heated molten metal can be canceled, to thereby further avoid dripping of the molten metal from the ladle during transport. Consequently, casting accuracy can be further improved, and clean and safe working condition can be provided.

While the invention has been described in detail and with reference to specific embodiments thereof, it would be apparent to those skilled in the art that various changes and modifications may be made without departing from the spirit and scope of the invention as defined by the appended claims.

What is claimed is:

1. A low pressure die-casting apparatus including a metal mold having a casting port, and a ladle unit for retaining and transporting a predetermined amount of a molten metal in a metal pot to the casting port, the ladle unit having an upper portion, a bottom portion having a molten metal intake/discharge port formed therein, and an inner surface defining a molten metal accumulation space, the apparatus comprising:

the intake/discharge port of the ladle unit having a cross-sectional area in a range of from 20 to 80 $mm^2$, and the bottom portion of the ladle unit being operative to pressure contact with the casting port;

a molten metal pressurizing means switchable to one position for selectively applying pneumatic pressure to the accumulation space in order to positively discharge the molten metal through the intake/discharge port to the metal mold, the molten metal pressurizing means being switchable to another position;

a switching means connected between the molten metal pressurizing means and the upper portion of the ladle unit and switchable between a first position for isolating the accumulation space from an atmosphere and a second position for providing fluid communication between the accumulation space and the atmosphere; and a controller connected to the switching means and producing a first signal for driving the switching means between the first position and the second position, the controller also being connected to the molten metal pressurizing means and producing a second signal for selectively driving the molten metal pressurizing means between the one position and said another position;

wherein the switching means comprises:

a valve body having a first communication hole formed therein for providing direct fluid communication between the valve body and atmosphere, a second communication hole formed therein for providing fluid communication between the upper portion of the ladle unit and the molten metal pressurizing means, and a bore formed therein in communication with the upper portion;

an opening/closing valve movable in the valve body for selectively closing the bore and thereby blocking communication between the first communication hole and the accumulation space;

a pneumatic cylinder mounted on the valve body and defining therein an internal space;

a piston connected to the opening/closing valve and movable in the pneumatic cylinder, the piston dividing the internal space into a first chamber and a second chamber; and a cylinder driving mechanism for moving the piston to thereby move the opening/closing valve toward and away from the bore.

2. A low pressure die-casting apparatus including a metal mold having a casting port, and a ladle unit for retaining and transporting a predetermined amount of a molten metal in a metal pot to the casting port, the ladle unit having an upper portion, a bottom portion having a molten metal intake/discharge port formed therein, and an inner surface defining a molten metal accumulation space, the apparatus comprising:

the intake/discharge port of the ladle unit having a cross-sectional area in a range of from 20 to 80 $mm^2$, and the bottom portion of the ladle unit being operative to pressure contact with the casting port;

a molten metal pressurizing means switchable to one position for selectively applying pneumatic pressure to the accumulation space in order to positively discharge the molten metal through the intake/discharge port to the metal mold, the molten metal pressurizing means being switchable to another position;

a switching means connected between the molten metal pressurizing means and the upper portion of the ladle unit and switchable between a first position for isolating the accumulation space from an atmosphere and a second position for providing fluid communication between the accumulation space and the atmosphere; and a controller connected to the switching means and producing a first signal for driving the switching means between the first position and the second position, the controller also being connected to the molten metal pressurizing means and producing a second signal for selectively driving the molten metal pressurizing means between the one position and said another position;

further comprising a transfer means for transferring the ladle unit between the pot and the casting port; and suction means in communication with the molten metal accumulation space for reducing a fluid pressure therein during transfer of the ladle unit by the transfer means;

wherein the suction means comprises:

a pressurized fluid source;

an ejector connected to the pressurized fluid source for continuously providing a negative pressure therein because of a flow of the pressurized fluid in the ejector; and a change-over means connected to the controller and being fluidly connected to the accumulation space, the change-over means having a first change-over position disconnecting from the ejector and a second change-over position connecting to the ejector for applying negative pressure in the accumulation space; and wherein the switching means comprises:

a valve body having a first communication hole formed therein for providing direct fluid communication between the valve body and atmosphere, a second communication hole formed therein for providing fluid communication between the upper portion of the ladle unit and the molten metal pressurizing means, a third communication hole formed therein, and a bore formed therein in communication with the upper portion;

an opening/closing valve movable in the valve body for selectively closing the bore and thereby blocking communication between the first communication hole and the accumulation space;

a pneumatic cylinder mounted on the valve body and defining therein an internal space;

a piston connected to the opening/closing valve and movable in the pneumatic cylinder, the piston dividing the internal space into a first chamber and a second chamber; and a cylinder driving mechanism for moving the piston to thereby move the opening/closing valve toward and away from the bore, the change-over means being fluidly connected to the third communication hole.

3. A low pressure die-casting apparatus including a metal mold having a casting port, and a ladle unit for retaining and transporting a predetermined amount of a molten metal in a metal pot to the casting port, the ladle unit having an upper portion, a bottom portion having a molten metal intake/discharge port formed therein, the intake/discharge port remaining open in the presence of the molten metal, and an inner surface defining a molten metal accumulation space, the apparatus comprising:

the intake/discharge port of the ladle unit having a cross-sectional area in a range of from 20 to 80 $mm^2$, and the bottom portion of the ladle unit being operative to pressure contact with the casting port;

a molten metal pressurizing means switchable to one position for selectively applying pneumatic pressure to the accumulation space in order to positively discharge the molten metal through the intake/discharge port to the metal mold, the molten metal pressurizing means being switchable to another position;

a switching means connected between the molten metal pressurizing means and the upper portion of the ladle unit and switchable between a first position for isolating the accumulation space from an atmosphere and a second position for providing fluid communication between the accumulation space and the atmosphere; and a controller connected to the switching means and producing a first signal for driving the switching means between the first position and the second position, the controller also being connected to the molten metal pressurizing means and producing a second signal for selectively driving the molten metal pressurizing means between the one position and said another position.

4. The low pressure die-casting apparatus as claimed in claim 3, wherein the switching means comprises:

a first electromagnetic valve fluidly connected to the upper portion of the ladle unit, the first electromagnetic valve having a solenoid connected to the controller and a biasing means, the biasing means urging the first electromagnetic valve into the second position where the accumulation space is communicated with the atmosphere, the solenoid switching the electromagnetic valve into the first position against the urging of the biasing means upon receiving the first signal outputted from the controller, the first position isolating the accumulation space from the atmosphere when the molten metal pressurizing means is in said another position.

5. The low pressure die-casting apparatus as claimed in claim 4, wherein the molten metal pressurizing means comprises:

a second electromagnetic valve having a second solenoid connected to the controller and a second biasing means, the second biasing means urging the second electromagnetic valve into said another position, the second solenoid switching the second electromagnetic valve into the one position against the urging of the second biasing means upon receiving the second signal outputted from the controller;

a pressurized fluid source for supplying pressurized fluid to the accumulation space when the second electromagnetic valve is in the one position and the switching means is in the first position.

6. The low pressure die-casting apparatus as claimed in claim 5, wherein the molten metal pressurizing means further comprises:

a pressure regulation valve provided between the pressurized fluid source and the second electromagnetic valve for providing a pressurized fluid to the second electromagnetic valve at a predetermined pressure; and a flow rate regulation valve provided between the second electromagnetic valve and the first electromagnetic valve for regulating the pressurized fluid and supplying the fluid to the first electromagnetic valve.

7. The low pressure die-casting apparatus as claimed in claim 3, wherein the switching means comprises:

a valve body having a first communication hole formed therein in communication with the molten metal pressurizing means and a bore formed therein in communication with the upper portion;

an opening/closing valve movable in the valve body for selectively closing the bore;

a pneumatic cylinder mounted on the valve body, the pneumatic cylinder defining therein an internal space;

a piston connected to the opening/closing valve and movable in the pneumatic cylinder, the piston dividing the internal space into a first chamber and a second chamber; and a cylinder driving mechanism for moving the piston to thereby move the opening/closing valve toward and away from the bore.

8. The low pressure die-casting apparatus as claimed in claim 7 wherein the cylinder driving mechanism comprises:

a first electromagnetic valve connected to the first chamber and the second chamber of the pneumatic cylinder, the first electromagnetic valve having one solenoid and another solenoid those connected to the controller for switching the first electromagnetic valve between a bore close position and a bore open position in response to the first signal sent from the controller; and a pressurized fluid source connected to the first electromagnetic valve for selectively supplying pressurized fluid into the first chamber of the pneumatic cylinder when the first electromagnetic valve is in the bore close position and into the second chamber of the pneumatic cylinder when the first electromagnetic valve is in the bore open position.

9. The low pressure die-casting apparatus as claimed in claim 6 wherein the molten metal pressurizing means comprises:

a second electromagnetic valve having a second solenoid and biasing means, the biasing means urging the second electromagnetic valve into said another position, the second solenoid switching the second electromagnetic valve into the one position against the urging of the biasing means upon receiving the second signal outputted from the controller; and the pressurized fluid source connected to the second electromagnetic valve for supplying pressurized fluid to the accumulation space when the second electromagnetic valve is in the one position and the first electromagnetic valve is in the bore open position.

10. The low pressure die-casting apparatus as claimed in claim 9, wherein the molten metal pressurizing means further comprises:

a pressure regulation valve provided between the pressurized fluid source and the second electromagnetic valve for providing pressurized fluid to the second electromagnetic valve at a predetermined pressure; and a flow rate regulation valve provided between the second electromagnetic valve and the first communication hole for regulating the pressurized fluid and supplying the regulated pressurized fluid to the valve body.

11. The low pressure die-casting apparatus as claimed in claim 3, wherein the switching means comprises:

a valve body having a first communication hole formed therein for providing direct fluid communication between the valve body and atmosphere, a second communication hole formed therein for providing fluid communication between the upper portion of the ladle unit and the molten metal pressurizing means, and a bore formed therein in communication with the upper portion;

an opening/closing valve movable in the valve body for selectively closing the bore and whereby blocking communication between the first communication hole and the accumulation space;

a pneumatic cylinder mounted on the valve body and defining therein an internal space;

a piston connected to the opening/closing valve and movable in the pneumatic cylinder, the piston dividing the internal space into a first chamber and a second chamber; and a cylinder driving mechanism for moving the piston to thereby move the opening/closing valve toward and away from the bore.

12. The low pressure die-casting apparatus as claimed in claim 11, wherein the cylinder driving mechanism comprises:

a first electromagnetic valve connected to the first chamber and the second chamber of the pneumatic cylinder, the first electromagnetic valve having one solenoid and another solenoid those connected to the controller for switching the first electromagnetic valve between a bore close position and a bore open position according to the first signal sent from the controller; and a pressurized fluid source connected to the first electromagnetic valve for selectively supplying pressurized fluid into the first chamber of the pneumatic cylinder when the first electromagnetic valve is in the bore close position and into the second chamber of the pneumatic cylinder when the first electromagnetic valve is in the bore open position.

13. The low pressure die-casting apparatus as claimed in claim 12, wherein the molten metal pressurizing means comprises:

a second pneumatic cylinder in communication with the second communication hole;

a second piston slidably movable in the second pneumatic cylinder;

a third pneumatic cylinder having an internal space;

a third piston connected to the second piston, the third piston dividing an internal space of the third pneumatic cylinder into one cylinder chamber and another cylinder chamber;

a second electromagnetic valve connected to the one and another cylinder chambers, and having a second solenoid connected to the controller, the second solenoid switching the second electromagnetic valve into the one position upon receiving the second signal outputted from the controller; and said pressurized fluid source being also connected to the second electromagnetic valve for applying the pressurized fluid to the one cylinder chamber to compress fluid in the accumulation space.

14. The low pressure die-casting apparatus as claimed in claim 13, further comprising transfer means for transferring the ladle unit between the pot and the casting port.

15. The low pressure die-casting apparatus as claimed in claim 14, wherein the controller generates a suction signal, and wherein the second electromagnetic valve further comprises a third solenoid connected to the controller for switching the second electromagnetic valve into the another position in response to the suction signal, the molten metal pressurizing means also serving as suction means for reducing a fluid pressure in the accumulation space during transfer of the ladle unit by the transfer means, the pressurized fluid source being connected to the another cylinder chamber by the third solenoid for decompressing the pressure in the accumulation space.

16. The low pressure die-casting apparatus as claimed in claim 3, further comprising a transfer means for transferring the ladle unit between the pot and the casting port.

17. The low pressure die-casting apparatus as claimed in claim 16, further comprising suction means in communication with the molten metal accumulation space for reducing a fluid pressure therein during transfer of the ladle unit by the transfer means.

18. The low pressure die-casting apparatus as claimed in claim 17, wherein the suction means comprises:

a pressurized fluid source;

an ejector connected to the pressurized fluid source for continuously providing a negative pressure therein because of a flow of the pressurized fluid in the ejector; and a change-over means connected to the controller and being fluidly connected to the accumulation space, the change-over means having a first change-over position disconnecting from the ejector and a second change-over position connecting to the ejector for applying negative pressure in the accumulation space.

19. The low pressure-die casting apparatus as claimed in claim 18, wherein the switching means comprises:

a valve body having a first communication hole formed therein for providing direct fluid communication between the valve body and atmosphere, a second communication hole formed therein for providing fluid communication between the upper portion of the ladle unit and the molten metal pressurizing means, a third communication hole formed therein, and a bore formed therein in communication with the upper portion;

an opening/closing valve movable in the valve body for selectively closing the bore and thereby blocking communication between the first communication hole and the accumulation space;

a pneumatic cylinder mounted on the valve body and defining therein an internal space;

a piston connected to the opening/closing valve and movable in the pneumatic cylinder, the piston dividing the internal space into a first chamber and a second chamber; and a cylinder driving mechanism for moving the piston to thereby move the opening/closing valve toward and away from the bore, the change-over means being fluidly connected to the third communication hole.

* * * * *